US012710227B2

(12) United States Patent
Vandroux et al.

(10) Patent No.: US 12,710,227 B2
(45) Date of Patent: Aug. 18, 2026

(54) INSTALLATION AND METHOD FOR LIQUEFYING A CRYOGENIC FLUID

(71) Applicant: L'Air Liquide, Societe Anonyme pour l'Etude et l'Exploitation des Procedes Georges Claude, Paris (FR)

(72) Inventors: Emeline Vandroux, Sassenage (FR); Alexandre Bacle, Champigny-sur-Marne (FR); Alexandre Pey, Champigny-sur-Marne (FR); Damien Mazurek, Champigny-sur-Marne (FR); Yasmin Khalil-Paillier, Champigny-sur-Marne (FR); Bhadri Prasad, Champigny-sur-Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 181 days.

(21) Appl. No.: 18/757,980

(22) Filed: Jun. 28, 2024

(65) Prior Publication Data

US 2025/0003676 A1 Jan. 2, 2025

(30) Foreign Application Priority Data

Jun. 29, 2023 (FR) ..... 2306889

(51) Int. Cl.
*F25J 1/02* (2006.01)
*F25J 1/00* (2006.01)

(52) U.S. Cl.
CPC ..... *F25J 1/0243* (2013.01); *F25J 1/001* (2013.01); *F25J 1/0065* (2013.01); *F25J 1/0067* (2013.01); *F25J 1/0204* (2013.01); *F25J 2290/62* (2013.01)

(58) Field of Classification Search
None
See application file for complete search history.

(56) References Cited

U.S. PATENT DOCUMENTS 5,127,230 A * 7/1992 Neeser ..... F17C 13/025 62/7
5,924,291 A * 7/1999 Weiler ..... F17C 9/02 62/48.1

(Continued)

FOREIGN PATENT DOCUMENTS

CN 108 131 896 6/2018
CN 116 123 816 5/2023

(Continued)

OTHER PUBLICATIONS

French Search Report for FR 2 306 889, mailed Jan. 16, 2024.

*Primary Examiner* — Jenna M Maroney
(74) *Attorney, Agent, or Firm* — Justin K. Murray

(57) ABSTRACT

Installation and method for liquefying a cryogenic fluid, such as hydrogen, utilizing a supply circuit connected in parallel to multiple cryogenic stores. A cooling device including a refrigerator with a refrigeration cycle of a cycle gas provides cooling power to the supply circuit through a set of heat exchangers. The installation includes a liquid withdrawal system for filling external tanks and a common pressurization unit. This pressurization unit features a common heater connected in parallel to the stores through pressurization ducts and valves, allowing for the simultaneous or individual pressurization of the stores by drawing off, heating, and returning fluid. The heater specifically comprises two heat exchangers arranged in parallel, with a valve assembly configured to distribute fluid flow between them to ensure operational redundancy and continuous heating capability.

8 Claims, 1 Drawing Sheet

(56) References Cited

U.S. PATENT DOCUMENTS

| | | | | |
|---|---|---|---|---|
| 9,657,986 | B2 * | 5/2017 | Bernhardt | F25J 1/0007 |
| 2018/0100696 | A1 * | 4/2018 | Demolliens | F25J 1/0237 |
| 2020/0149684 | A1 | 5/2020 | Bernhardt et al. | |

FOREIGN PATENT DOCUMENTS

| | | | | |
|---|---|---|---|---|
| FR | 2970563 | A1 * | 7/2012 | F25J 1/004 |
| FR | 3061533 | B1 * | 1/2020 | F17C 5/06 |
| FR | 3 088 415 | | 5/2020 | |
| JP | 2007071266 | A * | 3/2007 | |
| KR | 102200373 | B1 * | 1/2021 | F17C 9/00 |
| WO | WO-2016166468 | A1 * | 10/2016 | F25J 3/069 |

* cited by examiner

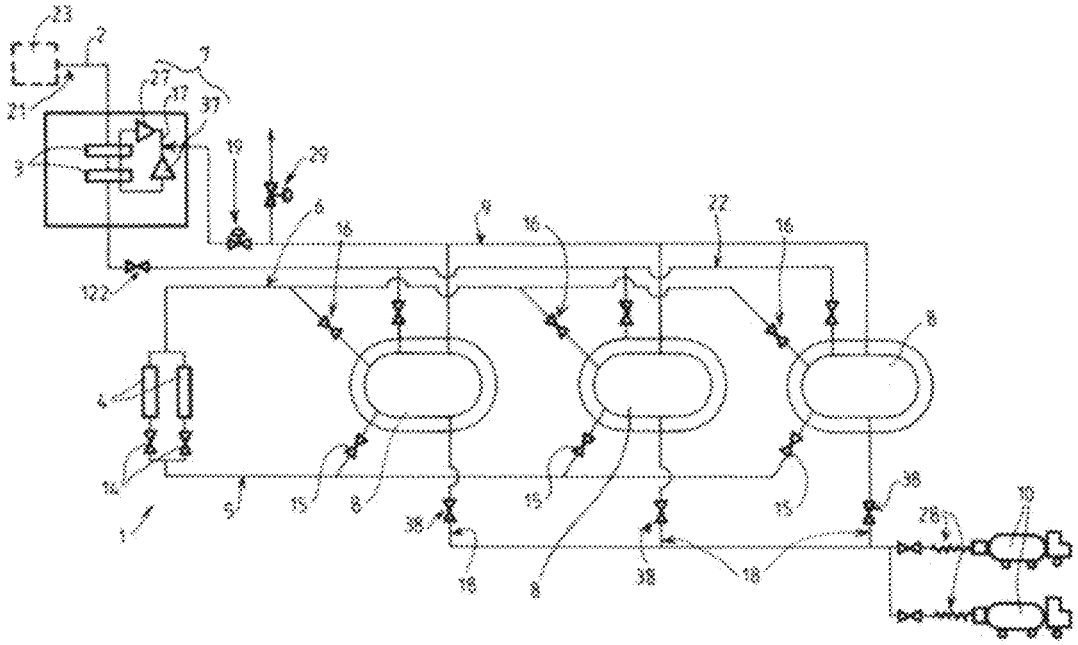

INSTALLATION AND METHOD FOR LIQUEFYING A CRYOGENIC FLUID

CROSS REFERENCE TO RELATED APPLICATIONS

This application claims the benefit of priority under 35 U.S.C. § 119 (a) and (b) to French patent application No. FR2306889, filed Jun. 29, 2023, which is herein incorporated by reference in its entirety.

FIELD OF THE INVENTION

The invention relates to an installation and a method for liquefying a cryogenic fluid, for example hydrogen.

BACKGROUND OF THE INVENTION

The invention more particularly relates to an installation for liquefying a cryogenic fluid, for example hydrogen, comprising a circuit for supplying fluid to be cooled that is provided with an upstream end intended to be connected to a source of gas and a downstream end connected in parallel to a plurality of cryogenic stores for liquefied fluid, the installation comprising a set of heat exchanger(s) in heat exchange with the supply circuit and a cooling device in heat exchange with the set of heat exchanger(s), said cooling device comprising a refrigerator with a cycle of refrigeration of a cycle gas comprising, for example, at least one of: hydrogen, helium, the installation comprising a set of liquid withdrawal ducts provided with a set of valve(s) and connecting the stores to at least one connecting end intended to be connected to a tank to be filled.

Hydrogen liquefiers are generally connected to liquid stores that are themselves connected to loading bays in order to fill trucks. Cf. for example FR3088415 A1.

These architectures are relatively expensive and require a large number of components.

SUMMARY OF THE INVENTION

An aim of the present invention is to overcome all or some of the disadvantages of the prior art identified above.

To this end, the installation according to certain embodiments of the invention, the installation may include a common heater connected in parallel to the plurality of cryogenic stores for fluid via a set of pressurization ducts provided with valves, the set of pressurization ducts and the corresponding valve(s) being configured to allow the pressurization of each of the cryogenic stores via drawing off liquid from the store, heating the drawn-off liquid in the common heater and returning the heated fluid to the store.

Furthermore, embodiments of the invention may have one or more of the following features:

- the set of liquid withdrawal ducts comprises a common duct portion connected in parallel to each of the stores and connected in parallel to the at least one connecting end, so as to allow a plurality of stores to simultaneously supply the at least one connecting end with liquid,
- the set of pressurization ducts comprises a first common duct portion connected in parallel to the lower portion of each of the stores and connected to a first end of the heater, the set of pressurization ducts comprising a second common duct portion connected to a second end of the heater and connected in parallel to each of the stores,

- the heater comprises two heat exchangers disposed in parallel, each ensuring an exchange of heat between the fluid conveyed by the set of pressurization ducts and a heating fluid, for example air,
- the installation comprises a set of valve(s) configured to distribute the flow of the fluid conveyed by the set of pressurization ducts into the one or two heat exchangers disposed in parallel,
- the installation comprises a set of return duct(s) connecting the upper portion of each of the stores to the refrigerator and/or to the supply circuit and configured to make it possible to transfer vaporization gas from the one or more stores to the refrigerator and/or the supply circuit,
- the set of return duct(s) comprises a common duct portion connected in parallel to the upper portion of each of the stores, said common duct portion comprising a common isolation or flow and/or pressure control valve,
- the common duct portion of the set of return duct(s) comprises a bypass provided with a discharge valve configured to allow the discharge of the gas stream to receiver or air venting.

The invention also relates to a method for producing and storing a liquefied cryogenic fluid using an installation in accordance with any one of the features above or below, the method comprising a step of pressurizing a plurality of or all of the stores simultaneously via the common heater.

The invention may also relate to any alternative device or method comprising any combination of the features above or below within the scope of the claims.

Further particular features and advantages will become apparent upon reading the following description, which is provided with reference to the figures, in which:

BRIEF DESCRIPTION OF THE DRAWINGS

The invention will be understood better from reading the following description and from studying the accompanying figures. These figures are given only by way of illustration and do not in any way limit the invention.

FIG. 1 is a schematic and partial view illustrating an example of the structure and operation of an installation according to the invention.

DETAILED DESCRIPTION OF THE INVENTION

Throughout the figures, the same references relate to the same elements.

In this detailed description, the following embodiments are examples. Although the description refers to one or more embodiments, this does not mean that the features apply only to a single embodiment. Individual features of different embodiments can also be combined and/or interchanged to provide other embodiments.

The illustrated installation 1 for liquefying a cryogenic fluid, for example for liquefying hydrogen, comprises a circuit 2 for supplying fluid to be cooled that is provided with an upstream end 21 intended to be connected to a source 23 of gas (for example electrolyser or reformer).

The supply circuit 2 has a downstream end 22 connected in parallel to a plurality of cryogenic stores 8 for liquefied fluid (typically double-walled stores that are thermally insulated in a vacuum). The stores 8 can be filled simultaneously by the liquefier, for example via the opening of a common valve 122.

The installation 1 comprises a set of heat exchanger(s) 3 in heat exchange with the supply circuit 2 (two in the schematic illustration). The installation 1 also has a cooling device 7 in heat exchange with the set of heat exchanger(s) 3. This cooling device comprises a cryogenic refrigerator 7 with a cycle of refrigeration of a cycle gas comprising, for example, at least one of: hydrogen, helium.

Typically, the refrigerator 7 comprises a cycle circuit 17 in which the cycle gas is subjected to a thermodynamic cycle (compression 27, cooling, expansion 37 and heating) so as to produce a cooling power that is transferred to the supply circuit 2 in order to liquefy the gas. The installation 1 may also have a pre-cooling device (not shown) in heat exchange with a part of the set of heat exchanger(s) 3 so as to ensure intermediate cooling (for example around 80K) of the fluid to be cooled between its temperature at the upstream end 21 and its temperature at the downstream end 22 (for example around 20K).

The installation 1 comprises a set of liquid withdrawal ducts 18 provided with a set of valves 38 and connecting the stores 8 to at least one connecting end 28 (which is for example flexible) intended to be connected to a tank 10 to be filled.

As illustrated, the set of liquid withdrawal ducts 18 may comprise a common (collecting) duct portion connected in parallel to each of the stores 8 and connected in parallel to the one or more connecting ends 28. This may allow a plurality of stores 8 to simultaneously supply the one or more connecting ends 28 with liquid.

The installation 1 comprises a common heater 4 connected in parallel to the plurality of cryogenic stores 8 for fluid via a set of pressurization ducts 5, 6 provided with valves 15, 16. The set of pressurization ducts 5, 6 and the corresponding valve(s) 15, 16 are configured to allow the pressurization of each of the cryogenic stores 8 via drawing off liquid from the store 8, heating the drawn-off liquid in the common heater 4 and returning the heated fluid to the store 8. The set of pressurization ducts 5, 6 may in particular comprise a first common duct portion connected in parallel to the lower portion of each of the stores 8 (so as to draw off liquid) and also connected to a first end of the heater 4. The set of pressurization ducts 5, 6 may also comprise a second common duct portion connected to a second end of the heater 4 (so as to recover the heated fluid) and connected in parallel to each of the stores 8 (so as to re-inject the fluid in order to increase the pressure within the one or more stores 8.

This means that the common heater 4 connected in parallel to the plurality of cryogenic stores 8 for fluid forms a common pressurization unit (PBU, pressure building unit) allowing each of the stores 8 to be pressurized, or even a plurality of stores 8 to be pressurized simultaneously. Thus, the installation 1 may comprise a single heater 4 for a plurality of distinct stores 8.

This allows advantageous sharing of equipment and lines, making it possible to limit the cost of stores, interconnections and operation.

As illustrated, the heater 4 may comprise or be constituted of two distinct heat exchangers disposed in parallel and each ensuring an exchange of heat between the fluid conveyed by the set of pressurization ducts 5, 6 and a heating fluid, for example air. The circuit may comprise a set of distribution valve(s) 14 configured to distribute the flow of the fluid conveyed by the set of pressurization ducts 5, 6 into the one or two heat exchangers disposed in parallel. These two distinct heat exchangers 4 disposed in parallel can each be dimensioned so as to ensure the heating of the entirety of the flow to be heated. This means that this heating function can be doubled so as to ensure the possibility of heating by a heat exchanger 4 while the other heat exchanger 4 is temporarily unavailable (for example iced up). Thus, preferably, during heating only one of the exchangers 4 is used.

As illustrated, the installation 1 may also comprise a set of return ducts 9 connecting the upper portion of each of the stores 8 to the refrigerator 7 and/or to the supply circuit 2 and configured to make it possible to transfer vaporization gas from the one or more stores 8 to the refrigerator 7 and/or the supply circuit 2 (when the natures of the gases are compatible).

The set of return duct(s) 9 in particular comprises a common duct portion connected in parallel to the upper portion of each of the stores 8 (so as to recover vaporization gas). This common duct portion may comprise a common valve 19 for isolation or control of the flow to the liquefier. Of course, the connections of this common duct to each of the stores 8 may also each be provided with a valve at each store 8.

In addition, as illustrated, the common duct portion of the set of return ducts 9 preferably has a bypass provided with a discharge valve 29 configured to allow the discharge of the gas stream to receiver or air venting, for example, when the pressure and/or flow and/or nature of the gas cannot be recycled to the supply circuit and/or the refrigerator.

The installation 1 thus has a plurality of cryogenic stores 8 for liquid that share one or more components and that can be used as a single store both for the pressurization and for the withdrawal or filling thereof.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

We claim:

1. An installation for liquefying a cryogenic fluid, the installation comprising:

a supply circuit configured to supply fluid to be cooled that is provided with an upstream end that is configured to receive gas from a source of gas and a downstream end connected in parallel to a plurality of cryogenic stores for liquefied fluid;

a set of heat exchanger(s) in heat exchange with the supply circuit and a cooling device in heat exchange with the set of heat exchanger(s), said cooling device comprising a refrigerator with a cycle of refrigeration of a cycle gas comprising at least one of: hydrogen and/or helium;

a set of liquid withdrawal ducts provided with a set of valve(s) and connecting the plurality of cryogenic stores to at least one connecting end configured to connect to a tank to be filled;

a common heater connected in parallel to the plurality of cryogenic stores for fluid via a set of pressurization ducts provided with valves, the set of pressurization ducts and the corresponding valve(s) being configured to allow the pressurization of each of the cryogenic stores via drawing off liquid from the store, heating the drawn-off liquid in the common heater and returning the heated fluid to the store and in that the heater comprises two heat exchangers disposed in parallel, each ensuring an exchange of heat between the fluid conveyed by the set of pressurization ducts and a heating fluid; and a set of valve(s) configured to distribute the flow of the fluid conveyed by the set of pressurization ducts into the one or two heat exchangers disposed in parallel.

2. The installation according to claim 1, wherein the set of liquid withdrawal ducts comprises a common duct portion connected in parallel to each of the stores and connected in parallel to the at least one connecting end, so as to allow a plurality of stores to simultaneously supply the at least one connecting end with liquid.

3. The installation according to claim 1, wherein the set of pressurization ducts comprises a first common duct portion connected in parallel to the lower portion of each of the stores and connected to a first end of the heater, the set of pressurization ducts comprising a second common duct portion connected to a second end of the heater and connected in parallel to each of the stores.

4. The installation according to claim 1, further comprising a set of return duct(s) connecting the upper portion of each of the stores to the refrigerator and/or to the supply circuit and configured to make it possible to transfer vaporization gas from the one or more stores to the refrigerator and/or the supply circuit.

5. The installation according to claim 4, wherein the set of return duct(s) comprises a common duct portion connected in parallel to the upper portion of each of the stores, said common duct portion comprising a common isolation or flow and/or pressure control valve.

6. The installation according to claim 5, wherein the common duct portion of the set of return duct(s) comprises a bypass provided with a discharge valve configured to allow the discharge of the gas stream to receiver or air venting.

7. A method for producing and storing a liquefied cryogenic fluid using an installation in accordance with claim 1, the method comprising a step of pressurizing a plurality of or all of the stores simultaneously via the common heater.

8. The method as claimed in claim 7, wherein the cryogenic fluid is hydrogen.

* * * * *